US009165459B2

(12) United States Patent
Tanaka

(10) Patent No.: US 9,165,459 B2
(45) Date of Patent: Oct. 20, 2015

(54) RADIO CONTROL TRANSMITTER

(71) Applicant: Futaba Corporation, Mobara-shi, Chiba-ken (JP)

(72) Inventor: Masahiro Tanaka, Mobara (JP)

(73) Assignee: FUTABA CORPORATION, Mobara-Shi, Chiba-Ken (JP)

( * ) Notice: Subject to any disclaimer, the term of this patent is extended or adjusted under 35 U.S.C. 154(b) by 317 days.

(21) Appl. No.: 13/761,389

(22) Filed: Feb. 7, 2013

(65) Prior Publication Data

US 2013/0207828 A1 Aug. 15, 2013

(30) Foreign Application Priority Data

Feb. 10, 2012 (JP) ..... 2012-027087

(51) Int. Cl.
*G08C 19/00* (2006.01)
*A63H 30/04* (2006.01)
*G08C 17/02* (2006.01)

(52) U.S. Cl.
CPC ..... *G08C 19/00* (2013.01); *A63H 30/04* (2013.01); *G08C 17/02* (2013.01)

(58) Field of Classification Search
CPC ..... G08C 19/00; A63H 30/04; G08C 17/02
USPC ..... 341/176; 340/12.22; 701/2; 446/456; 318/581
See application file for complete search history.

(56) References Cited

U.S. PATENT DOCUMENTS

| | | | | |
|---|---|---|---|---|
| 6,417,780 | B1 * | 7/2002 | Naruke et al. | 340/12.5 |
| 2009/0171516 | A1 * | 7/2009 | Reich | 701/2 |
| 2011/0077801 | A1 * | 3/2011 | Tanaka | 701/2 |

FOREIGN PATENT DOCUMENTS

| | | |
|---|---|---|
| JP | 2000-24334 | 1/2000 |
| JP | U3079600 | 6/2001 |

* cited by examiner

*Primary Examiner* — Edwin Holloway, III
(74) *Attorney, Agent, or Firm* — Bacon & Thomas, PLLC

(57) ABSTRACT

A transmitter for controlling a target to be controlled having a motor, the transmitter includes: a start-up manipulation member to control starting and stopping of the motor; a rotational speed control manipulation member to control a rotational speed of the motor according to an operation amount; a control unit to generate the steering signal such that the motor is rotated according to the operation amount of the rotational speed control manipulation member when the operation amount of the rotational speed control manipulation member is equal to or greater than a preset start position while the start-up manipulation member is in a start-up state; and a transmitting unit to transmit the steering signal.

6 Claims, 5 Drawing Sheets

RADIO CONTROL TRANSMITTER

CROSS-REFERENCE TO RELATED APPLICATIONS

This application claims priority to Japanese Patent Application No. 2012-027087 filed on Feb. 10, 2012, the entire contents of which are incorporated herein by reference.

FIELD OF THE INVENTION

The present invention relates to a transmitter which performs a radio control of a model, and more particularly to a radio control transmitter which performs a drive control of a motor that is a power unit of a model.

BACKGROUND OF THE INVENTION

A radio control system uses radio waves to remotely control a target to be controlled (Hereinafter, referred to as a control target) at a remote location. In this radio control system, an operator controls, with a transmitter, the control target such as a model airplane, a model helicopter, a model car, or the like. The system has been used in hobby applications to compete in the field of control technology in regards to speed and acrobatics, or in applications of industrial equipment to control a control target such as a lawn mower or a crane.

The transmitter of the radio control system is a device for controlling a control target, and includes a transmitting unit which transmits a steering signal corresponding to the operation of the operator.

The control target includes a receiving unit which receives the steering signal, and the receiving unit sends a control signal based on the steering signal. The control signal controls a power unit such as a motor or an engine, and a drive control device such as a servo device which performs a drive control of each key or throttle of the engine, and a gyro device which maintains the stability of an aircraft.

Regarding the control of the servo device, for example, Japanese Patent Laid-open Publication No. 2000-024334 discloses a technology in which an adjustment value is changed at a switching point that has been arbitrarily set, the adjustment value for determining a relationship between the operation amount of a manipulation member provided in the transmitter and the operation amount of the servo device.

Further, regarding the control of the engine that has been conventionally used in the power unit, for example, Japanese Utility Model Registration No. 3079600 discloses a technology in which the rotational speed of the engine is controlled using a manipulation lever, a switch and the like provided in the transmitter. Particularly, in this technology, the rotational speed of the engine promptly returns to an idling value that has been initially set when the switch is turned to ON after the engine has been stopped.

Recently, in the field of the radio control system for hobby applications, a motor is often used as a power unit in a control target such as a model airplane or a model glider. The model airplane of the conventional radio control system usually uses an engine as a power unit, and the control method thereof is different from that of the motor.

For example, in a conventional control target of using an engine as a power unit, since restarting of the engine causes loss of fuel or troublesome operations after the engine is stopped, it is set to be in an idling state where the engine performs a minimum rotation when a lever for controlling the engine makes contact with one end of a movable range.

Alternatively, in the airplane or glider using a motor as a power unit, one arbitrary manipulation member set by the operator is used to control the motor. When using a lever as the manipulation member, it is set such that the rotation of the motor is stopped when the lever makes contact with one end of its movable range, and the rotation of the motor is maximized when the lever is brought into contact with the other end thereof.

As described above, when the lever is operated to be in contact with one end of the movable range, the rotation of the motor serving as a power unit is stopped. Accordingly, the rotation of a propeller, which is provided in the control target, is stopped to change a load associated with the control target. Thus, the operation feels different from that of a control target using the engine as the power unit.

Further, in order to maintain the motor at a low rotational speed as in the idling state of the engine, the operator needs to maintain the manipulation member at an operation amount at which the rotational speed of the motor is suitable, which is difficult to require a very delicate operation.

Even in the case of using the motor as the power unit, there has been a demand for a control that can be achieved by the same operation (e.g., the control of the low rotational speed) as the control target using the engine as the power unit.

SUMMARY OF THE INVENTION

In view of the above, the present invention provides a transmitter which can implement a safe drive of a motor included in a control device and reproduce an idling state of the motor by associatively using a start-up manipulation member and a rotational speed control manipulation member.

In accordance with an aspect of the present invention, there is provided a transmitter for controlling a target to be controlled having a motor as a power unit by transmitting a steering signal, the transmitter includes: a start-up manipulation member to control starting and stopping of the motor; a rotational speed control manipulation member to control a rotational speed of the motor according to an operation amount thereof; a storage unit to store a start position that is an operation amount of the rotational speed control manipulation member at which the motor starts to rotate; a control unit to generate the steering signal such that the motor is rotated according to the operation amount of the rotational speed control manipulation member when the operation amount of the rotational speed control manipulation member is equal to or greater than the start position while the start-up manipulation member is in a start-up state; and a transmitting unit to transmit the steering signal.

Further, the control unit may generate the steering signal such that the motor is rotated at a low rotational speed without being stopped even if the operation amount of the rotational speed control manipulation member is less than the start position while the motor is rotating.

The transmitter may further include a setting unit to set the start position.

The transmitter may further include a rotational speed adjustment manipulation member which can set the rotational speed of the motor being rotated at a low rotational speed.

In the control of the motor serving as the power unit that is included in the control target in a radio control system, a manipulation member for controlling the starting and stopping of the motor, and a manipulation member for controlling the rotational speed of the motor are provided and the control is performed in association with the manipulation members.

Further, in the rotational speed control manipulation member for controlling the rotational speed of the motor, a start position at which the motor starts to rotate is provided. Accordingly, even if the start-up manipulation member goes from a stop state to a start-up state, when the operation amount of the rotational speed control manipulation member is less than the start position, the motor is not rotated, and it is possible to prevent the motor from being accidentally rotated.

Further, if the motor is rotating, even when the operation amount of the rotational speed control manipulation member is less than the start position, the motor continues to rotate at a low rotational speed. Thus, the idling state can be reproduced, and the control can be performed with the same operation feeling as in the control target using an engine as the power unit.

In addition, by providing the setting unit, the start position can be set arbitrarily by an operator. Further, by using the rotational speed adjustment manipulation member, it is possible to set the rotational speed of the motor being rotated at a low rotational speed.

BRIEF DESCRIPTION OF THE DRAWINGS

The objects and features of the present invention will become apparent from the following description of embodiments, given in conjunction with the accompanying drawings, in which.

DETAILED DESCRIPTION OF THE EMBODIMENTS

Hereinafter, embodiments of the present invention will be described with reference to the accompanying drawings which form a part hereof.

Figure 1:
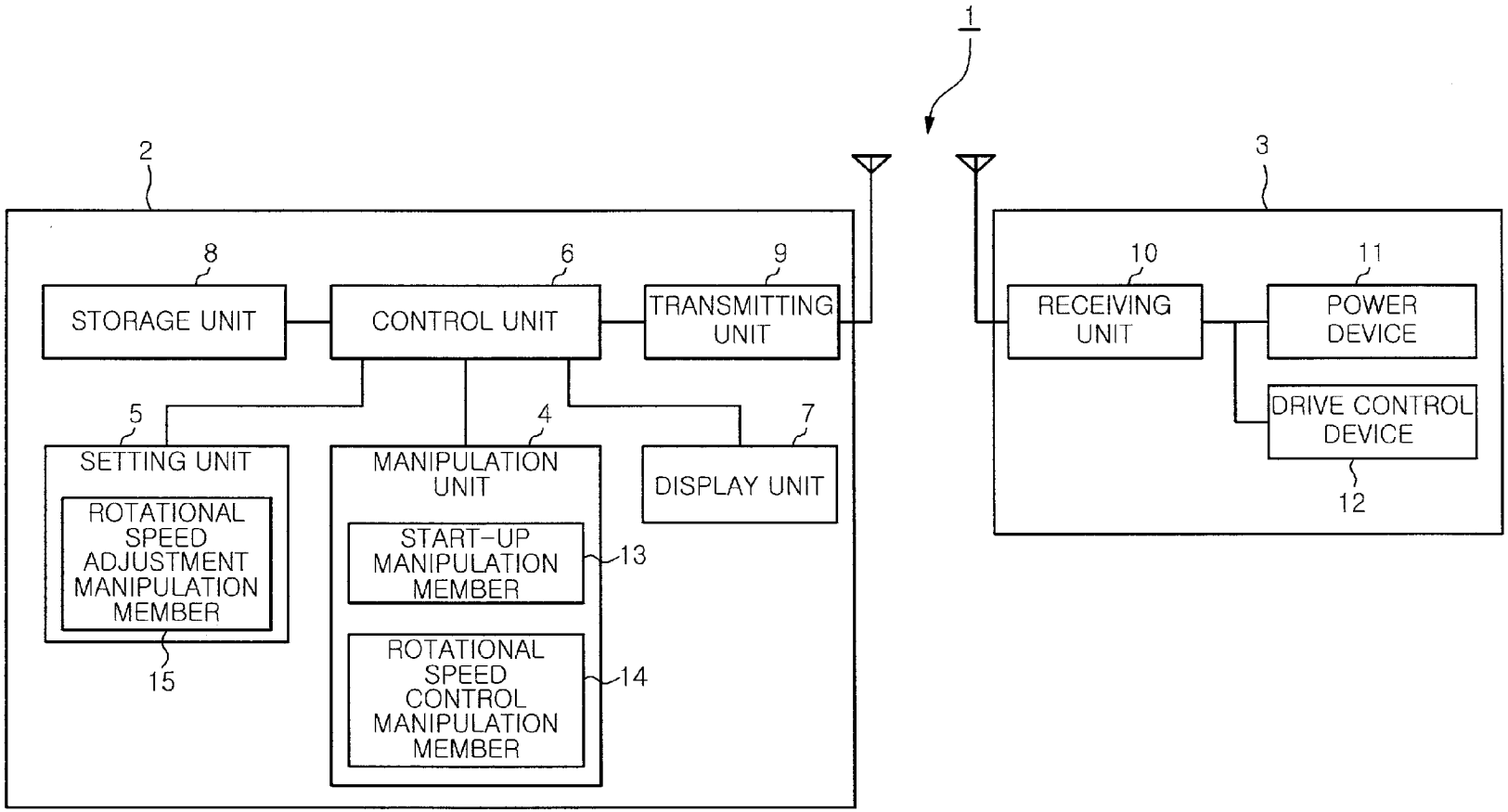
FIG. 1 is a block diagram of a radio control system in accordance with an embodiment of the present invention.
Figure 2:
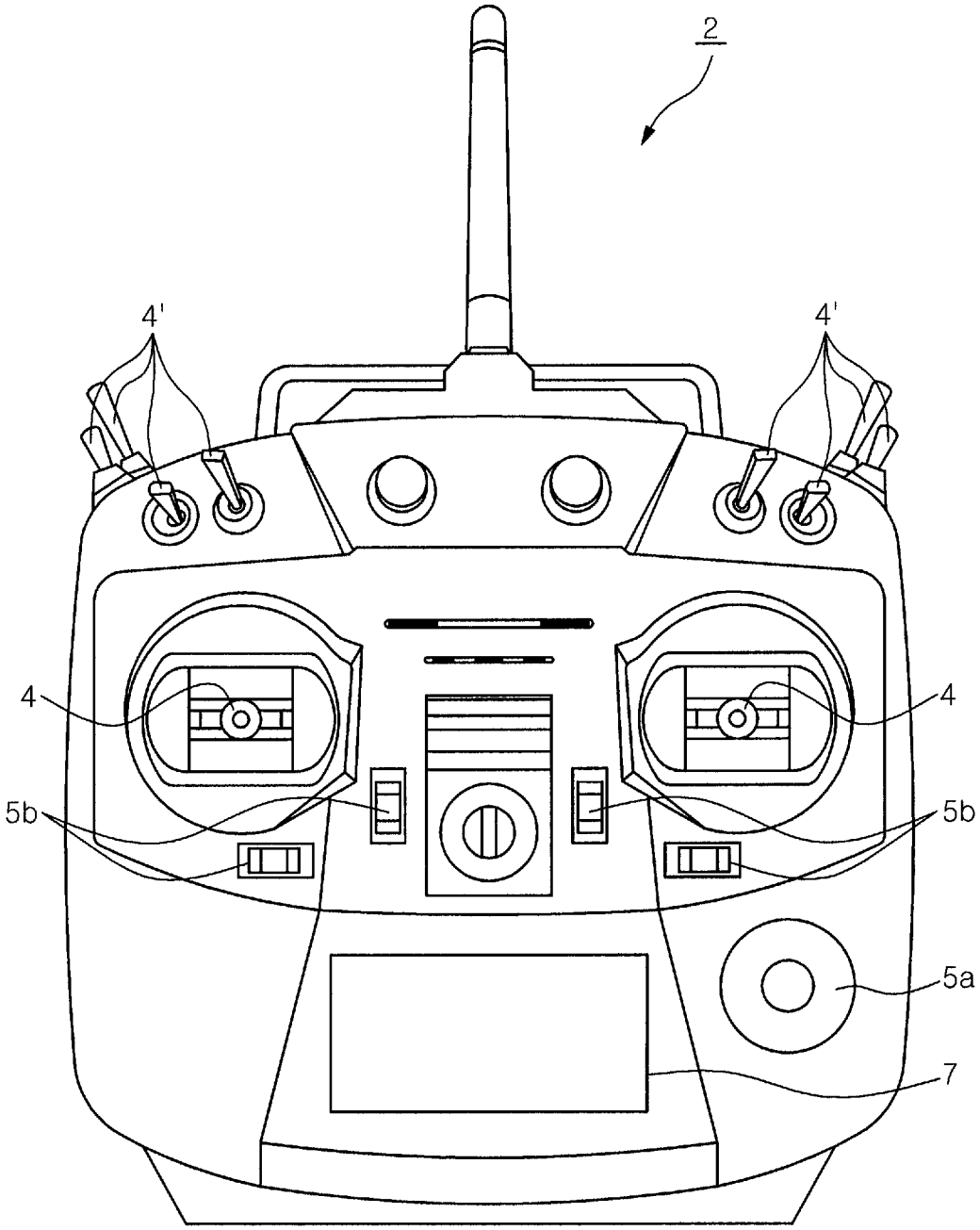
FIG. 2 is a diagram schematically showing a transmitter.

An embodiment of the present invention will be described with reference to FIGS. 1 and 2. FIG. 1 is a block diagram of a radio control system 1. FIG. 2 is a view schematically showing a transmitter 2.

The transmitter 2 is a device for controlling a control target 3 such as a model airplane, a model glider, or the like. An operator performs a drive control of the control target 3 by operating a manipulation unit 4 and 4'. In the present invention, the control target 3 is driven by a motor serving as a power unit 11.

The manipulation unit 4 and 4' includes manipulation members such as levers and switches. Further, the operator can arbitrarily designate a lever 4 or a switch 4' as a start-up manipulation member 13 for start-up of the motor and a rotational speed control manipulation member 14 for controlling the number of rotational speed of the motor. In this embodiment, the rotational speed control manipulation member 14 is preferably assigned to one of the levers 4.

A setting unit 5 performs setting of the transmitter 2. As the setting unit 5, a switch or a lever may be used in addition to a touch sensor 5*a* shown in FIG. 2.

Trim switches 5*b* shown in FIG. 2 are provided in the vicinity of the levers 4, and respectively correspond to the movable directions (up, down, left and right) of the left and right levers 4. The trim switches 5*b* are used as one component of the setting unit 5.

The control unit 6 generates a steering signal for driving the control target 3 according to the operation of the manipulation unit 4 and 4'. Further, the control unit 6 alters the setting of the transmitter 2 according to the details set by the setting unit 5. The control unit 6 includes a central processing unit (CPU) that actually performs the processing.

A display unit 7 displays information of the control target 3, various setting data changed according to the operation of the setting unit 5 and the like.

A storage unit 8 is a memory that stores various settings of the transmitter 2.

The transmitting unit 9 is a transmission circuit for transmitting a steering signal.

The receiving unit 10 of the control target 3 is a reception circuit for receiving the steering signal transmitted from the transmitting unit 9 of the transmitter 2. The receiving unit 10 demodulates the steering signal and outputs a control signal to the power unit 11 or a drive control device 12 which is connected to the receiving unit 10.

The power unit 11, which is the motor, supplies a power to the control target 3. Further, a motor controller (not shown) is provided between the receiving unit 10 and the motor.

The drive control device 12 is a servo device, gyro device, or the like, which controls driving of each key of the control target 3 or other parts. Although it has been described as a single block in FIG. 1, a plurality of types of devices may be provided in an appropriate number for each type depending on the control target 3.

Figure 3:
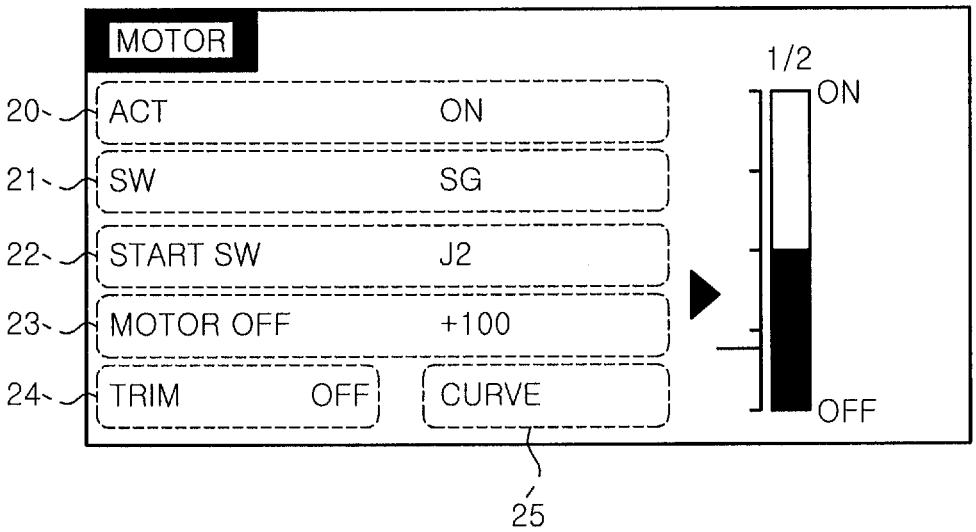
FIG. 3 is an example of the display unit of the transmitter in accordance with the embodiment of the present invention.

A method of actually using the present invention will be described with reference to FIGS. 3 to 5. FIG. 3 is an example of the display unit 7 of the transmitter 2. The settings can be changed by selecting a display of an item intended to be set by using the setting unit 5. By configuring the settings as shown in FIG. 3, the motor is controlled by associating the start-up manipulation member 13 with the rotational speed control manipulation member 14.

Figure 4:
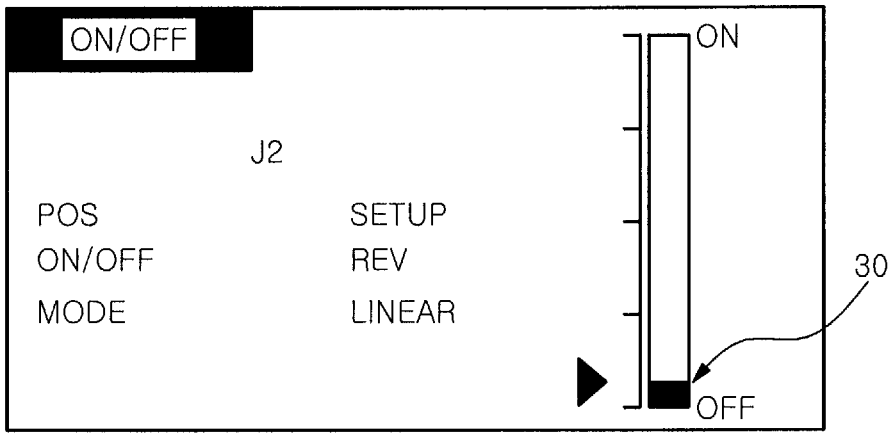
FIG. 4 is an example of the display unit which shows settings of a rotational speed control manipulation member in accordance with the embodiment of the present invention.

FIG. 4 is an example of the display unit 7 which shows the settings of the rotational speed control manipulation member 14. FIG. 5 is an example of the display unit 7 showing a relationship between the rotational speed of the motor and the operation amount of the rotational speed control manipulation member 14.

An 'ACT' 20 shown in FIG. 3 represents the validity/invalidity of a function of controlling the motor with a plurality of manipulation members. In the case of FIG. 3, the function of controlling the motor with a plurality of manipulation members is set to be valid.

A 'SW' 21 represents which manipulation member has been assigned to the start-up manipulation member 13. For example, in FIG. 3, a manipulation member 'SG' is set as the start-up manipulation member 13 when one of the manipulation members of the manipulation unit 4 and 4' is assumed as 'SG'.

A 'START SW' 22 represents which manipulation member has been assigned to the rotational speed control manipulation member 14. For example, in FIG. 3, a manipulation member 'J2' is set as the rotational speed control manipulation member 14 when one of the manipulation members of the manipulation unit 4 and 4' is assumed as 'J2'.

A 'MOTOR OFF' 23 represents the operation amount of the start-up manipulation member 13 at which the motor stops the rotation, and a line is displayed in a bar on the right side in FIG. 3. The position of the bar and a value displayed in the 'MOTOR OFF' 23 correspond to the operation amount of the start-up manipulation member 13 at which the rotation of the motor is stopped.

A 'TRIM' 24 indicates the presence or absence of a function of enabling the value displayed in the 'MOTOR OFF' 23 to be set by one of the trim switches 5*b*.

Figure 5:
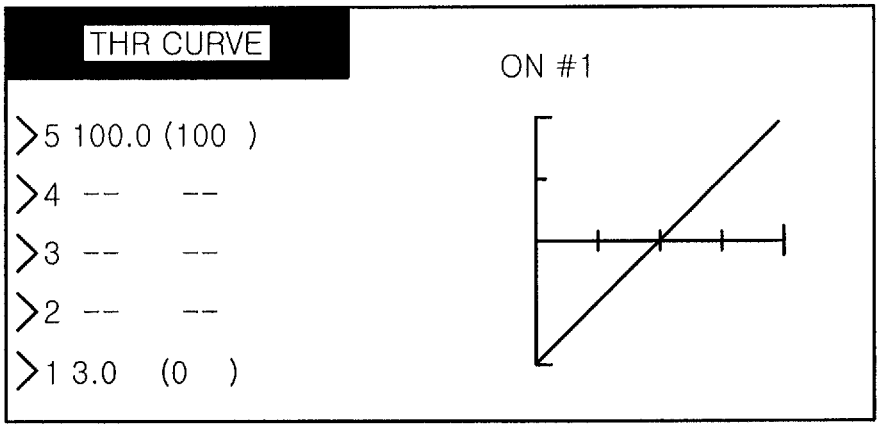
FIG. 5 is an example of the display unit showing a relationship between the rotational speed of the motor and the operation amount of the rotational speed control manipulation member in accordance with the embodiment of the present invention.

Further, when a 'CURVE' 25 is selected, a throttle curve that is an adjustment value of the rotational speed of the motor and the operation amount of the rotational speed control manipulation member 14 is displayed in the display unit 7, as shown in FIG. 5.

As displayed in the 'SW' 21 and the 'START SW' 22 of FIG. 3, manipulation members can be arbitrarily assigned to the start-up manipulation member 13 and the rotational speed control manipulation member 14. However, when one of the levers 4 is assigned to the rotational speed control manipulation member 14, it is possible to adjust the operation amount of the rotational speed control manipulation member 14 and the rotational speed of the motor, and more precisely control the rotational speed of the motor.

FIG. 4 shows an example of the display unit 7 that displays the settings of a lever 'J2' when the lever 'J2' is assigned as the rotational speed control manipulation member 14. A start position 30 is displayed in a bar showing a movable range of the lever. The start position indicates the operation amount of the lever at which the motor starts to rotate by the lever after the start-up manipulation member 13 has gone from the stop state to the start-up state.

A 'POS' represents a setting of position information of the lever. The start position 30 can be determined through the setting of the 'POS'. An 'ON/OFF' is set as reverse in FIG. 4, which means the upper side of the lever is set as ON. A 'MODE' indicates a setting of a case where the lever serves as a switch. In the mode of 'LINEAR', the lever J2', i.e., the switch becomes ON and OFF around a set point.

Further, in the screen of the throttle curve that is displayed by selecting the 'CURVE' 25 of FIG. 3, the rotational speed of the motor and the operation amount of the rotational speed control manipulation member 14 can be set by using the setting unit 5. In the example of FIG. 5, one end of the movable range of the rotational speed control manipulation member 14 is set such that the rotational speed of the motor is 3%, i.e., the motor is rotated at a low rotational speed, and the other end thereof is set such that the rotational speed of the motor is 100%.

After supplying power to the transmitter 2, when the operation amount of the rotational speed control manipulation member 14 is less than the start position while the start-up manipulation member 13 is in the start-up state, the motor does not rotate. Once the motor has started to rotate after the operation amount of the rotational speed control manipulation member 14 is equal to or greater than the start position, the motor is not stopped unless the start-up manipulation member 13 returns to a stop state. When the operation amount of the rotational speed control manipulation member 14 is less than the start position again, the motor is rotated at a low rotational speed set in advance.

Further, in order to start the rotation of the motor, it is required for the start-up manipulation member 13 to be in the start-up state, and for the rotational speed control manipulation member 14 to be operated such that the operation amount thereof is equal to or greater than the start position. Accordingly, although one of the manipulation members is mistakenly operated, it is possible to prevent the motor from being unexpectedly rotated.

Further, the rotational speed of the motor being rotated at a low rotational speed can be set by using a rotational speed adjustment manipulation member 15. One of the trim switches 5*b* can be assigned to the rotational speed adjustment manipulation member 15.

Figure 6:
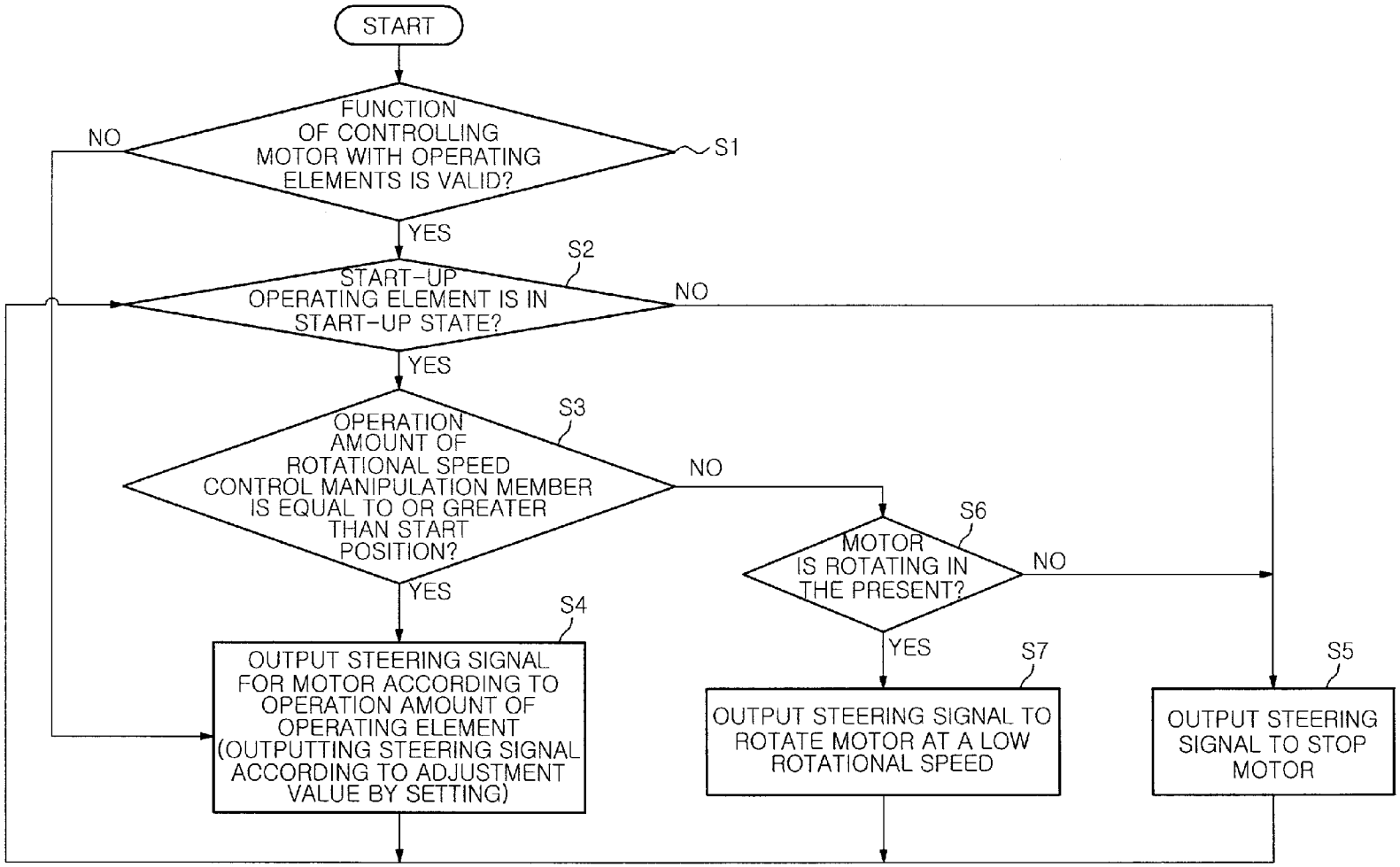
FIG. 6 is a flowchart showing the control of the motor according to the present invention.

Next, a flow of driving process of the motor will be described with reference to FIG. 6. FIG. 6 is a flowchart showing driving process of the motor.

First, the control unit 6 determines whether or not a function of controlling the motor with a plurality of manipulation members is valid in step S1. If the function of controlling the motor with a plurality of manipulation members is valid in step S1, it is determined whether the start-up manipulation member 13 is in the start-up state in step S2.

If the start-up manipulation member 13 is in the start-up state in step S2, the control unit 6 determines whether the operation amount of the rotational speed control manipulation member 14 is equal to or greater than the start position in step S3.

If the operation amount of the rotational speed control manipulation member 14 is equal to or greater than the start position in step S3, a steering signal for controlling the rotational speed of the motor is generated according to the operation amount of the rotational speed control manipulation member 14, and transmitted from the transmitting unit 9 to the receiving unit 10 of the control target 3 in step S4. Thereafter, the process returns to step S2 to again check whether or not the start-up manipulation member 13 is in the start-up state.

Further, if the function of controlling the motor with a plurality of manipulation members is invalid in step S1, a steering signal is generated according to the operation of one manipulation member for controlling the motor, and transmitted from the transmitting unit 9 to the receiving unit 10 of the control target in step S4, as in the conventional control of the control target using a motor as a power unit. In this case, the one manipulation member for controlling the motor may be one of the levers 4 and performs functions of both the start-up manipulation member 13 and the rotational speed control manipulation member 14.

Further, if the start-up manipulation member 13 is in the stop state in step S2, the control unit 6 generates a steering signal to stop the motor, and the steering signal is transmitted from the transmitting unit 9 to the receiving unit 10 of control target in step S5.

Further, the operation amount of the rotational speed control manipulation member 14 is less than the start position in step S3, the control unit checks whether or not the motor is rotating in the present in step S6.

If the motor is rotating in step S6, the control unit 6 generates a steering signal according to the adjustment value of the rotational speed of the motor that is set in advance, so that the motor can rotate at a low rotational speed in step S7.

On the contrary, if the motor is not rotating in step S6, a steering signal to stop the motor is outputted in step S5.

According to the embodiment for implementing the present invention described above, the start-up manipulation member 13 and the rotational speed control manipulation member 14 may be provided and in association with them, the motor mounted on the control target 3 may be controlled.

In particular, when the operation amount of the rotational speed control manipulation member 14 is less than the start position, since the motor does not rotate even if the start-up manipulation member 13 goes from the stop state to the start-up state, the motor can be started safely. Also, when the operation amount of the rotational speed control manipulation member 14 is less than the start position during the rotation of the motor, by setting the adjustment value of the rotational speed of the motor and the operation amount of the rotational speed control manipulation member 14, it is possible to continue the rotation of the motor and reproduce an idling state.

While the invention has been shown and described with respect to the embodiments, it will be understood by those skilled in the art that various changes and modifications may be made without departing from the scope of the invention as defined in the following claims.

What is claimed is:

1. A transmitter for controlling a control target having a motor as a power unit by transmitting a steering signal to the control target, the transmitter comprising:

a start-up manipulation member to control starting and stopping of the motor;

a rotational speed control manipulation member to control a rotational speed of the motor according to an operation amount thereof;

a storage unit to store a start position corresponding to an operation amount of the rotational speed control manipulation member at which the motor starts to rotate;

a control unit configured to generate the steering signal such that, while the start-up manipulation member is in a start-up state, the motor does not start to rotate until the operation amount of the rotational speed control manipulation member is increased to reach the start position and the motor is rotated according to the operation amount of the rotational speed control manipulation member when the operation amount of the rotational speed control manipulation member is equal to or greater than the start position; and a transmitting unit to transmit the steering signal.

2. The transmitter of claim 1, wherein the control unit generates the steering signal such that the motor is rotated at a constant rotational speed, without being stopped even if the operation amount of the rotational speed control manipulation member becomes less than the start position while the motor is rotating.

3. The transmitter of claim 1, further comprising a setting unit to set the start position.

4. The transmitter of claim 2, further comprising a setting unit to set the start position.

5. The transmitter of claim 2, further comprising a rotational speed adjustment manipulation member configured to set a value of the constant rotational speed.

6. The transmitter of claim 4, further comprising a rotational speed adjustment manipulation member configured to set a value of the constant rotational speed.

* * * * *